US012163382B2

(12) United States Patent
Otaibi

(10) Patent No.: US 12,163,382 B2
(45) Date of Patent: Dec. 10, 2024

(54) ANGLED DRILL PIPE NOZZLE ASSEMBLIES

(71) Applicant: SAUDI ARABIAN OIL COMPANY, Dhahran (SA)

(72) Inventor: Ali S. Otaibi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/060,138

(22) Filed: Nov. 30, 2022

(65) Prior Publication Data

US 2024/0175326 A1 May 30, 2024

(51) Int. Cl.
*E21B 17/00* (2006.01)

(52) U.S. Cl.
CPC ..... *E21B 17/006* (2013.01); *E21B 2200/01* (2020.05)

(58) Field of Classification Search
CPC ..... E21B 17/006; E21B 2200/01
See application file for complete search history.

(56) References Cited

U.S. PATENT DOCUMENTS 2,805,043 A * 9/1957 Williams, Jr. ..... E21B 21/103 137/115.11
7,051,821 B2 5/2006 Samuel

FOREIGN PATENT DOCUMENTS

CN 104832093 A 8/2015

* cited by examiner

*Primary Examiner* — Crystal J Lee
(74) *Attorney, Agent, or Firm* — Vorys, Sater, Seymour and Pease LLP

(57) ABSTRACT

A drilling system includes a drill string extendable into a borehole from a drilling platform and conveying a drilling fluid to a drill bit arranged at a distal end of the drill string, an annulus defined between the drill string and an inner wall of the borehole and in which spent drilling fluid ejected from the drill bit flows back to the drilling platform, and a plurality of nozzle assemblies installed on the drill string, each nozzle assembly providing a fluid flow path between an interior of the drill string and the annulus. Each nozzle assembly is transitionable between a closed state, where the drilling fluid within the interior is prevented from passing through the fluid flow path, and an open state, where the drilling fluid traverses the fluid flow path and is discharged into the annulus to combine with the spent fluid.

15 Claims, 3 Drawing Sheets

ANGLED DRILL PIPE NOZZLE ASSEMBLIES

FIELD OF THE DISCLOSURE

The present disclosure relates generally to hydrocarbon exploration operations in a subterranean well and, more particularly, angled drill pipe nozzle assemblies for efficient borehole cleaning during subterranean well drilling operations.

BACKGROUND OF THE DISCLOSURE

Subterranean well drilling operations, such as those to recover hydrocarbons, typically involve the circulation of a drilling fluid (or "mud") through an interior length of drill pipe or "drill string". A drill bit is arranged at the distal end of the drill pipe and a mud pump operates to pump the drilling fluid into the drill pipe where it circulates to the drill bit and is discharged from the drill bit via a plurality of orifices. The drilling fluid helps lubricate and cool the drill bit, but also serves to convey (carry) borehole "cuttings" (e.g., rock debris, gravel, and other solid particulates) to the surface through an annulus defined between the exterior of the drill pipe and the wellbore wall. Carrying the cuttings to the surface also helps to ensure that the well is cleaned. This process is termed "borehole cleaning" or simply "hole cleaning," and grammatical variants thereof.

Inadequate borehole cleaning can lead to costly drilling problems, such as well pack off, which can lead to mechanical pipe sticking, formation fracturing, excessive torque and drag on the drill pipe, and difficulties in logging and cementing, for example. Optimization of borehole cleaning remains one of the major challenges when planning and drilling wells, particularly extended reach and deviated wells. Efficient borehole cleaning requires effective transport of cuttings through the annular space and thus sufficient annular velocity and/or drilling fluid rheological qualities to suspend the cuttings within the drilling fluid for the entire length of the well and resist settling within the borehole prior to reaching the surface. However, as drilling fluid flows through nozzles within the drill bit, it loses much of its annular velocity and force, resulting in a reduction of its sweeping and suspension capabilities and thus sub-optimal borehole cleaning capacity.

With respect to the aforementioned considerations, the present disclosure provides apparatuses, systems, and methods for improved borehole cleaning, particularly for use in extended reach and deviated subterranean wells.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a drilling system is provided. The drilling system includes a drill string that is extendable into a borehole from a drilling platform. A drilling fluid is conveyed to a drill bit at a distal end of the drill string. An annulus is defined between the drill string and an inner wall of the borehole, through which spent drilling fluid ejected from the drill bit flows back to the drilling platform. A plurality of nozzle assemblies are installed on the drill string and each nozzle assembly provides a flow path between an interior of the drill string and the annulus. Each nozzle assembly is transitionable between a closed state and an open state. When in the closed state, drilling fluid within the interior of the drill string is prevented from passing through the flow path. When in the open state, drilling fluid traverses the flow path and is discharged into the annulus to combine with the spent fluid.

According to an embodiment consistent with the present disclosure, a method of drilling a borehole is provided. The method includes extending a drill string into the borehole from a drilling platform. The drill string includes a drill bit at a distal end of the drill string. A plurality of nozzle assemblies are installed on the drill string. Each nozzle assembly provides a flow path between an interior of the drill string and an annulus defined between the drill string and an inner wall of the borehole. The method includes conveying a drilling fluid into the drill string and to the drill bit, and discharging a spent drilling fluid from the drill bit and into the annulus. The method further includes transitioning at least one of the plurality of nozzle assemblies from a closed state, where the drilling fluid within the interior is prevented from passing through the fluid flow path, to an open state, where the drilling fluid traverses the fluid flow path and is discharged into the annulus. The method further includes combining the drilling fluid discharged into the annulus with the spent drilling fluid and thereby aiding the spent drilling fluid in carrying drill cuttings uphole within the annulus.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
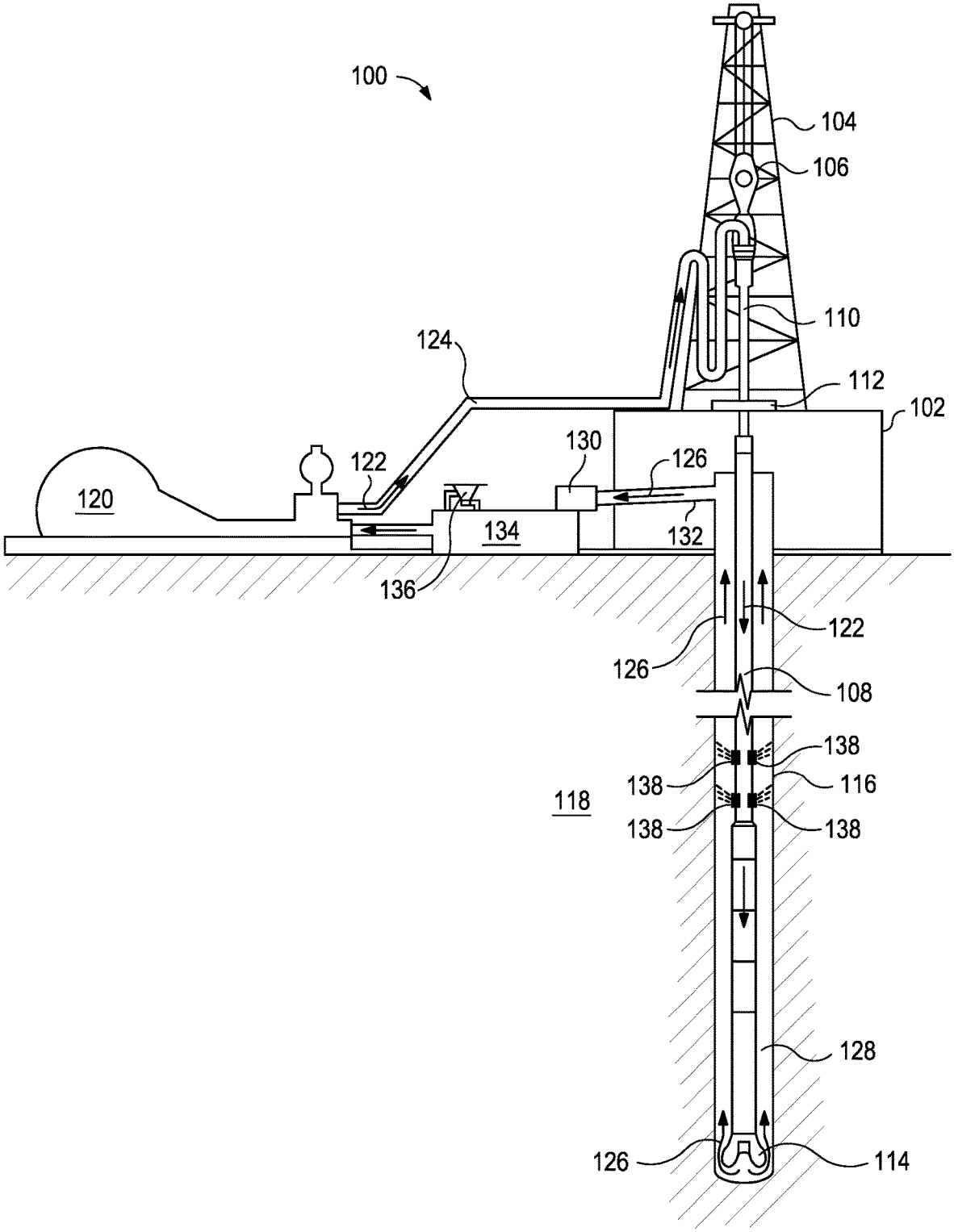
FIG. 1 illustrates an example drilling system that may embody or otherwise employ one or more principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate hydrocarbon exploration operations in a subterranean well and, more particularly, angled drill pipe nozzles for efficient borehole cleaning during subterranean well drilling operations. In particular, embodiments in accordance with the present disclosure relate to drill pipe that includes a plurality of nozzle assemblies that facilitate a fluid flow path between the interior of the drill pipe and the exterior of the drill pipe to discharge drilling fluid. The nozzle assemblies are configured to be scalable, such that they have a closed position and an open position. When in the closed position, the fluid flow path is occluded and fluid does not flow or only flows minimally between the interior of the drill pipe and the exterior of the drill pipe. Conversely, when in the open position, the fluid flow path is exposed and drilling fluid is able to be discharged from the interior of the drill pipe to the exterior via the nozzle assemblies. The sealing (or unscaling) of the nozzle assemblies is controlled using an actuatable spring and scaling mechanism activated based on hydraulic pressure within the interior of the drill pipe during subterranean well drilling operations (i.e., controlled hydraulically from the surface at drilling fluid pumping pressures). In some embodiments, the angle of the nozzles included in the nozzle assemblies can be selected to maximize annular fluid velocity, and may be the same or different across a length of the drill pipe. Moreover the angle of the nozzles may be based on the specific drilling operation; e.g., directional drilling, vertical drilling, etc. The nozzle assemblies provide for efficient and improved cuttings removal and borehole cleaning, as described herein.

FIG. 1 depicts an example drilling system 100 that may employ the principles of the present disclosure. As illustrated, the drilling system 100 may include a drilling platform 102 that supports a derrick 104 having a traveling block 106 for raising and lowering a drill string 108. The drill string 108 may include, but is not limited to, drill pipe and coiled tubing. A kelly 110 supports the drill string 108 as it is lowered through a rotary table 112. A drill bit 114 is attached to the distal end of the drill string 108 and is driven either by a downhole motor or via rotation of the drill string 108 from the drilling platform 102. As the bit 114 rotates, it creates a borehole 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and ultimately through one or more orifices provided in the drill bit 114. The drilling fluid 122 helps to lubricate and cool the drill bit 114, but also entrains any cuttings generated by operation of the drill bit 114. A spent drilling fluid 126 including such cuttings is then circulated back to the surface via an annulus 128 defined between the drill string 108 and the walls of the borehole 116. At the surface, the spent drilling fluid 126 exits the annulus 128 and may be conveyed to one or more fluid processing unit(s) 130 via an interconnecting flow line 132. The fluid processing unit 130 operates to filter and clean the spent drilling fluid 126. After passing through the fluid processing units 130, a "cleaned" drilling fluid 122 is deposited into a nearby retention pit 134 (i.e., a mud pit). One or more chemicals, fluids, or additives may be added to the drilling fluid 122 via a mixing hopper 136 communicably coupled to or otherwise in fluid communication with the retention pit 134. The pump 120 then re-circulates the "cleaned" drilling fluid 122 back into the drill string 108 via the feed pipe 124 and the process starts over again.

According to the present disclosure, the drilling system 100 may further include a plurality of nozzle assemblies 138 attached to the drill string 108 at various locations to assist the spent drilling fluid 126 in circulating and removing the cuttings out of the borehole 116. Each nozzle assembly 138 forms a fluid path between the interior of the drill string 108 and the exterior of the drill string 108. While six nozzle assemblies 138 are shown in FIG. 1, more or less than six may be included in the drilling system 100, without departing from the scope of the present disclosure. Moreover, while pairs of nozzle assemblies 138 are shown axially aligned along the drill string 108 and otherwise arranged in respective common planes, the nozzle assemblies 138 may be randomly arranged along the drill string 108 in any pattern or configuration desired. That is, the particular location (e.g., uphole and/or downhole) and positioning (e.g., random and/or ordered positioning) of the nozzle assemblies 138 with reference to the drill pipe is not limited. Indeed, the location and angles of the nozzle assembles 138 may be distributed systematically along the drill string 108 by utilizing simulation software, taking into account borehole 116 geometry, length, and formation type and size. Moreover, while two nozzle assemblies 138 are shown in FIG. 1 aligned in respective common planes, it is contemplated herein that more or less than two nozzle assemblies 138 may be employed in a given plane, without departing from the scope of the present disclosure.

During drilling operations, the pump 120 circulates the drilling fluid 122 into the interior of the drill string 108 and to the drill bit 114, which increases the hydraulic pressure within the drill string 108. As long as the hydraulic pressure remains below a predetermined limit (value), the nozzle assemblies 138 remain scaled and otherwise non-operational (i.e., closed). When the hydraulic pressure reaches or exceeds the predetermined limit, however, one or more of the nozzle assemblies 138 may become unsealed and otherwise operational (i.e., open), thereby allowing a portion of the drilling fluid 122 to be ejected (discharged) into the annulus 128.

Discharging the drilling fluid 122 into the annulus 128 from the nozzle assemblies 138 may help assist in borehole cleaning and, more particularly, in the removal of the borehole cuttings entrained in the spent drilling fluid 126. When the hydraulic pressure descends back below the predetermined limit, the nozzle assemblies 138 may be configured to transition back to a sealed (closed) state once again, and the drilling fluid 122 is unable to pass through the nozzle assemblies 138. Because the drilling fluid 122 is able to be discharged through the nozzle assemblies 138 and not solely through the drill bit 114, improved borehole cleaning can be realized because annular velocity and force can be maintained at efficient values along a length of the borehole 116 to achieve cuttings suspension and removal.

While the drilling system 100 is depicted as a land-based operation, it will be appreciated that the principles of the present disclosure could equally be applied in any offshore, sea-based, or sub-sea application that employs a floating platform, a semi-submersible platform, or a sub-surface wellhead installation as known by one of skill in the art. Moreover, use of directional terms herein, such as above, below, upper, lower, upward, downward, uphole, downhole, and the like, are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. If used herein, the term "proximal" refers to that portion of the component being referred to that is closest to a named reference component or structure, and the term "distal" refers to the portion of the component that is farther (e.g., a relative distance) or furthest from a named reference component or structure.

Figure 2:
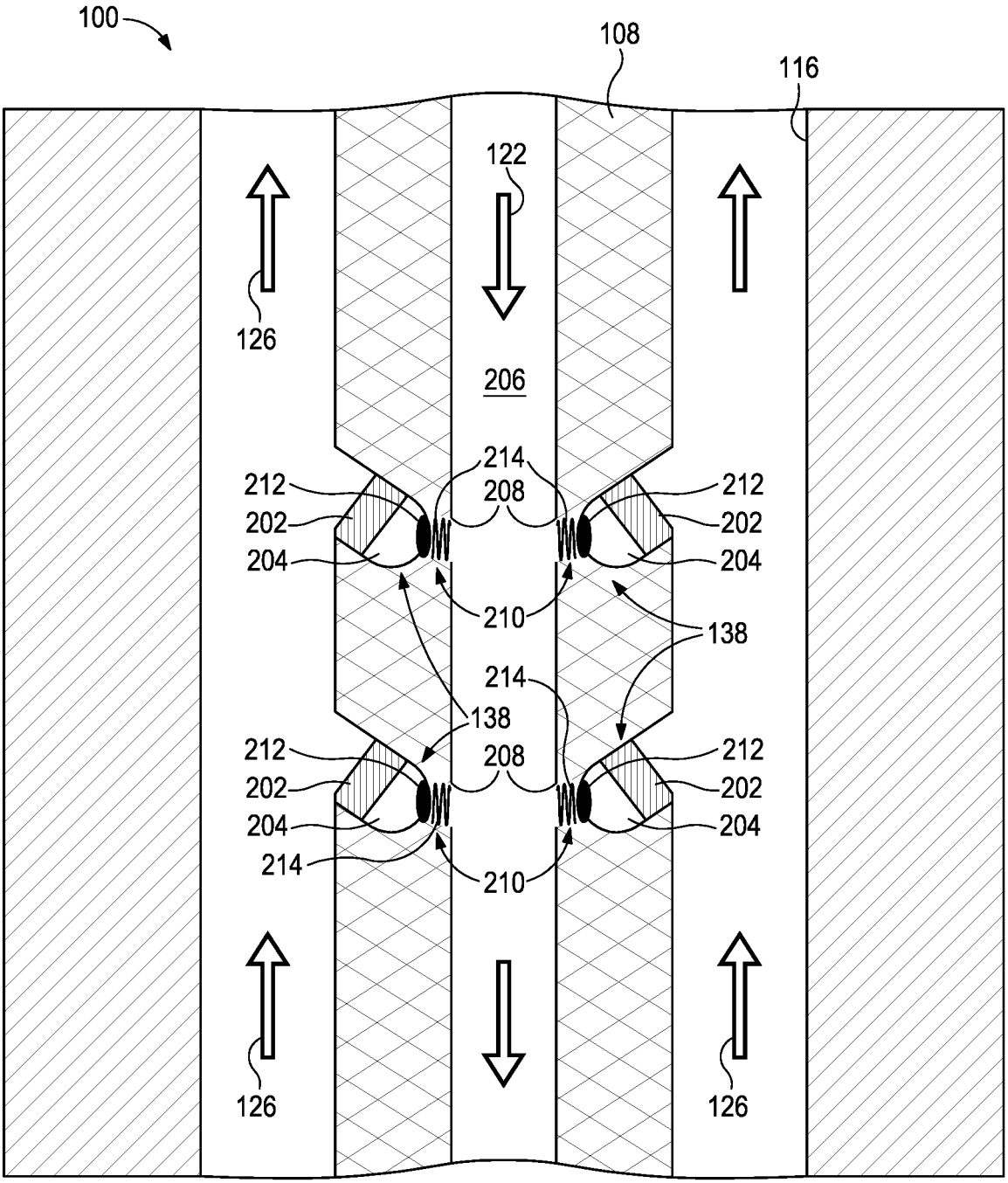
FIG. 2 is an enlarged cross-sectional view of a portion of the drilling system of FIG. 1, according to one or more embodiments.

FIG. 2 is a schematic cross-sectional view of an enlarged portion of the drilling system 100 of FIG. 1, according to one or more embodiments. More particularly, FIG. 2 depicts a plurality of the nozzle assemblies 138 (four shown) arranged in the drill string 108 extended within the borehole 116. While four nozzle assemblies 138 are shown, greater or less than four may be provided along the length of the drill string 108, and at any location along the drill string 108, as discussed above.

As illustrated, each nozzle assembly 138 includes a nozzle 202 secured within a dedicated pocket 204 provided or otherwise defined by the drill string 108. Each pocket 204 is defined in the outer surface (outer radial circumference) of the sidewall of the drill string 108 and may be sized to receive a corresponding one of the nozzles 202. Each nozzle 202 may be secured within its corresponding pocket 204 via a variety of ways including, but not limited to, threading, an interference fit, welding, an adhesive, or any combination thereof. As described in more detail below, each nozzle 202 is able to eject a fluid (e.g., the drilling fluid 122) from an interior 206 of the drill string 108 and into the surrounding annulus 128.

The nozzles 202 described herein are not particularly limited and may be any nozzle capable of operating in a subterranean environment and allowing fluid flow therethrough at and above the predetermined hydraulic pressures within the interior 206 of the drill string 108. In one or more aspects, the nozzles 202 may include, but are not limited to, threaded or standard jet nozzles. Moreover, one or more of the nozzles 202 may include size-adjustable ports to control flow area and velocity. The adjustable ports may be adjusted prior to beginning a drilling operation based on the particular parameters of the drilling operation to maximize borehole cleaning. The nozzles 202 may further freely rotate based on flow rate. Such free rotation can further enhance borehole 116 cleaning and lifting of cuttings.

Each pocket 204 may be in fluid communication with the interior 206 of the drill string 108 via an access opening 208 defined in the inner sidewall of the drill string 108. Accordingly, the pocket 204 and the access opening 208 may cooperatively define a passageway through the sidewall of the drill string 108 to place the interior 206 in fluid communication with the annulus 128. As described herein, however, the access opening 208 may be sealed (occluded) and unsealed (exposed) during operation, thus selectively allowing or preventing fluid flow from the interior 206 to the nozzles 202.

Each nozzle assembly 138 may further include a scaling mechanism 210 movable between a first or "closed" state and a second or "open" state. When the scaling mechanism 210 is in the closed state, the drilling fluid 122 present within the interior 206 of the drill string 108 is prevented from migrating into the pocket 204. In contrast, when the sealing mechanism 210 transitions to the open state, the drilling fluid 122 is able to access the pocket 204 and be discharged into the annulus 128 via the corresponding nozzle 202.

As illustrated, each sealing mechanism 210 includes a sealing member 212 and a biasing device or spring 214 operatively coupled to the sealing member 212. The spring 214 may be secured to the drill string 108 and at or near the access opening 208 and may comprise any type of biasing device capable of expanding from an unextended state (i.e., a free or natural position) to an extended state. In at least one embodiment, for example the spring 214 may comprise a coil or tension spring, and actuation of the spring 214 between the unextended and extended states may be based on hydraulic pressure within the interior 206 being below, or at or above, a tension force of the spring 214. Moreover, as the spring 214 transitions to the extended state, potential energy in the form of spring force builds in the spring 214.

Figure 3:
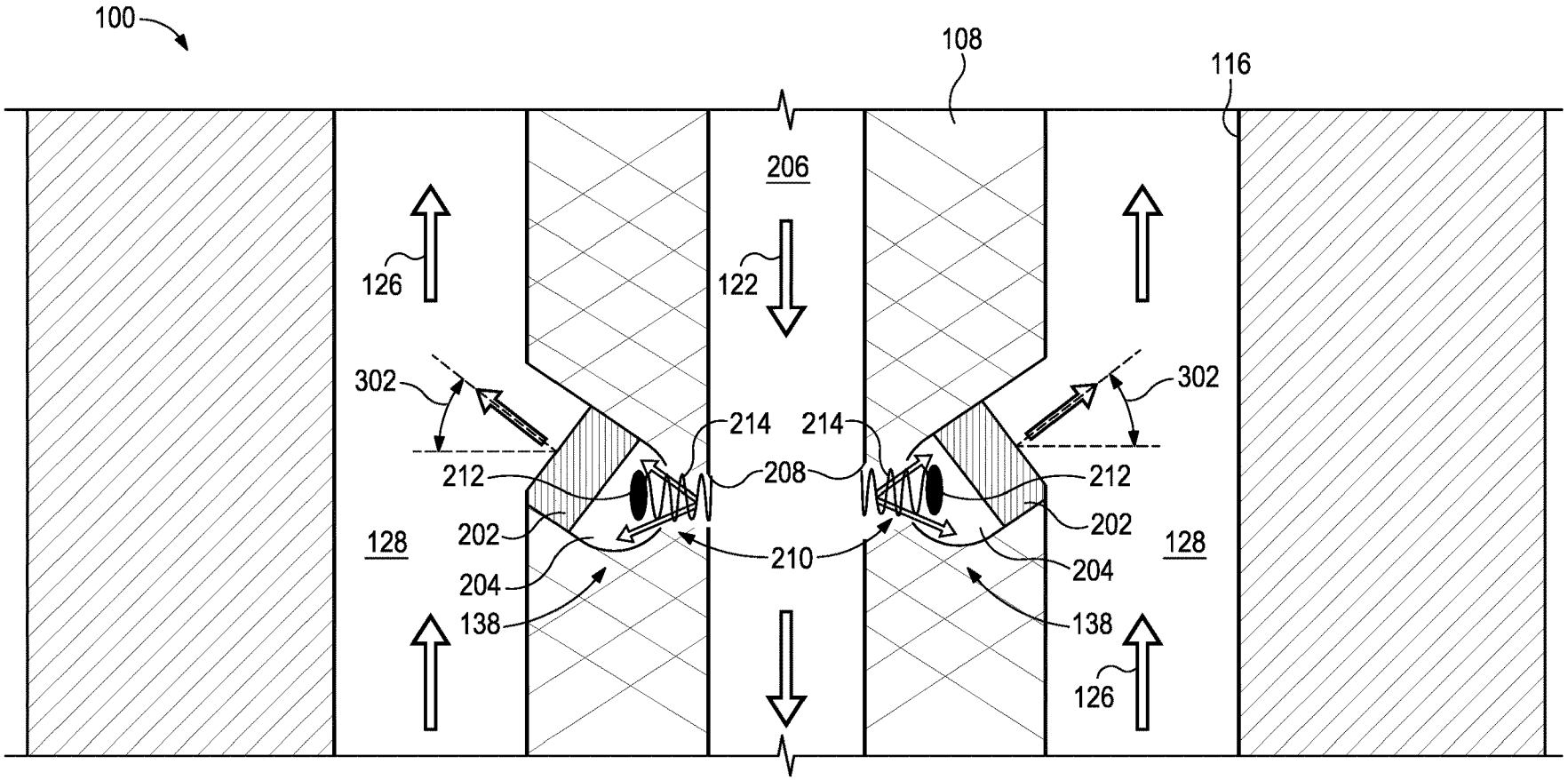
FIG. 3 is another enlarged cross-sectional view of the drilling system of FIG. 1 showing progressive operation of the nozzle assemblies, according to one or more embodiments of the present disclosure.

The sealing member 212 may be mechanically or otherwise physically anchored to the spring 214 such that actuation of the spring 214 between the unextended and extended states correspondingly moves the sealing element member 212. For example, the scaling member 212 may be coupled to the spring 214 using, but not limited to, a threaded engagement, an adhesive, and interference fit, a welded interface, or any combination thereof. When the spring 214 is in the unextended state, as shown in FIG. 2, the sealing member 212 generates a sealed interface at the access opening 208, which prevents fluid communication between the interior 206 and the annulus 128 at that location. In contrast, when the spring 214 is transitioned to the extended state, as shown in FIG. 3, the sealing member 212 moves away from the access opening 208, thus allowing the drilling fluid 122 within the interior 206 to migrate into the pocket 204 to be ejected into the annulus 128 via the corresponding nozzle 202.

The sealing member 212 may be composed of a material capable of generating a sealed interface at the access opening 208, and thereby preventing, or substantially preventing, fluid flow into the pocket 204 from the interior 206 of the drill string 108. For example, the sealing member 212 may be composed of a metal, a polymer, a rubber, or any combination thereof. Moreover, the sealing member 212 may also be shaped to mate with the access opening 208 and thereby generate the sealed interface. In such embodiments, the sealing member 212 may exhibit a cross-sectional shape such as, but not limited to, circular, spherical, hemispherical, polygonal, any combination thereof, or any other shape or configuration capable of occluding the access opening 208 and thereby generating the sealed interface.

Still referring to FIG. 2, when the spring 212 is in the unextended state, the spring 214 holds the sealing member 212 in sealing contact with the access opening 208, which prevents allow fluid flow from the interior 206 of the drill string 108 into the pocket 204. When the spring 212 is actuated (transitioned) to the extended state, as shown in FIG. 3, the sealing member 212 extends radially outward and into the interior of the pocket 204, thus separating the sealing member 212 from the access opening 208. With the sealing member 212 separated from the access opening 208, fluid flow from the interior 206 is allowed into the pocket 204 and the drilling fluid 122 is able to be ejected into the annulus 128 the other corresponding nozzle 202.

While FIG. 2 shows the sealing functionality of the sealing member 212 from the interior of the pocket 204 (i.e., interior chamber wall), it is also contemplated herein that the sealing functionality of the sealing member 212 may be from the exterior of the pocket 204 (e.g., exterior chamber wall), without departing from the scope of the present disclosure. In such instances, the sealing member 212 may preferably be composed of a pliable (e.g., deformable) polymeric material and/or have a polymeric sealing profile to ensure adequate sealing contact with the exterior of the pocket 204.

Referring now to FIG. 3, with continued reference to FIG. 2, example operation of the nozzle assemblies 138 is now provided, according to embodiments of the present disclosure. Similar to FIG. 2, FIG. 3 as an enlarged, schematic cross-sectional side view of the drilling assembly 100 of FIG. 1. In FIG. 3, however, only two nozzle assemblies 138 are shown for the sake of discussion.

During drilling operations, the drilling fluid 122 is pumped down the interior 206 of the drill string 108 and to the drill bit 114 (FIG. 1). When the hydraulic pressure of the drilling fluid 122 within the drill string 108 is less than the spring (tension) force of the spring 214, the nozzle assembly 138 remains in the sealed (closed) state, as shown in FIG. 2. With the nozzle assembly 138 in the sealed state, the drilling fluid 122 is substantially prevented from being discharged from the drill string 108 at the nozzle assembly 138. Rather, the drilling fluid exits the drill bit 114 and is circulated back to the drilling platform 102 (FIG. 1) within the annulus 128 as spent drilling fluid 126.

In FIG. 3, the nozzle assemblies 138 are shown transitioned to the extended state. To accomplish this, the hydraulic pressure of the drilling fluid 122 is increased to a predetermined limit that reaches or exceeds the spring (tension) force of the spring 214. Once the spring force of the spring 214 is surpassed, the sealing member 212 will be forced to separate from the access opening 208 and extend into the pocket 204. Separating the scaling member 212 from the access opening 208 facilitates fluid communication between the access opening 208 and the pocket 204, which allows the drilling fluid 122 within the drill string 108 to access the nozzle 202. Consequently, the drilling fluid 122 may be ejected into the annulus 128 via the nozzle 202.

Accordingly, during a drilling operation and when the nozzle assembly 138 is in an unsealed (opened) state, drilling fluid 122 is hydraulically pumped down the interior 206 of the drill string 108 at a pressure equal to or greater than that needed to extend the spring 214. A portion of the drilling fluid 122 exits the drill string 108 through the access opening 208 and the nozzle 202, and is discharged into the annulus 128. The drilling fluid 122 discharged into the annulus 128 may help the spent drilling fluid 126 carry cuttings and debris uphole within the annulus 128. The portion of the drilling fluid 122 that does not exit through the nozzle assemblies 138 continues downhole through the interior 206 of the drill string 108 until reaching the drill bit 114 (FIG. 1).

Still referring to FIG. 3, one or more of the nozzles 202 may be arranged within the corresponding pockets 204 at a predetermined angle 302. In some applications, as illustrated, the angle 302 may be measured relative to perpendicular from the adjacent sidewall of the borehole 116 or the centerline of the drill string 108. The angle 302 may range between about 1° and about 89°, but more preferably may range between about 20° and about 70°, or between about 35° and about 55°. In some embodiments, the angle 302 may be set such that the nozzles 202 discharge the drilling fluid 122 into the annulus 128 in a generally uphole direction. More particularly, the nozzles 202 may be angled such that the drilling fluid 122 is discharged generally in the same uphole direction as the spent drilling fluid 126 within the annulus 128, thus helping to assist the spent drilling fluid 126 to carry any cuttings or debris further uphole.

Therefore, the present disclosure provides a plurality of angled nozzle assemblies positioned along a length of a drill pipe. The angled nozzle assemblies are configured to provide fluid communication between the interior of the drill pipe and an annulus formed between the exterior of the drill pipe and a borehole. Each angled nozzle assembly includes a sealing mechanism that includes a spring and a sealing element operatively coupled to the spring and actuatable to occlude or expose an access opening of the interior of the drill pipe. A fluid flow pocket is located distal from the access opening relative to the sealing element, which seals the pocket when the spring is in an unextended state and unseals the pocket when the spring is in an extended state. A nozzle is located distal from the access opening relative to the pocket. When the spring is in the extended state, fluid communication between the access opening and the annulus through the entirety of the angled nozzle assembly is provided (i.e., through the access opening, into the chamber, and through the nozzle).

Each of the nozzle assemblies of the present disclosure are spaced apart and positioned along the length of the drill pipe to increase borehole cleaning efficiency compared to borehole cleaning solely through circulation of drilling fluid from a drill bit. The specific angle of the nozzles included in the nozzle assemblies may depend on a number of factors and may be designed to maximize borehole cleaning given a particular drilling operation. Accordingly, such arrangements and angles of the nozzle assemblies are not limited and may depend on various factors associated with a particular drilling operation such as, for example, the type of borehole being drilled (e.g., deviated, extended reach, vertical, tortuous), the type of subterranean formation being drilled (e.g., unconventional, conventional), annular velocity, and drilling fluid rheology, among other considerations.

Thus, the nozzle assemblies of the present disclosure save time, cost, and effort by improving borehole cleaning during drilling operations. Indeed, traditional borehole cleaning (through circulation through a drill bit only) may be initially less than effective, requiring lengthened drilling duration and additional volumes of drilling fluid to achieve desired borehole cleaning. The nozzle assemblies of the present disclosure, however, can minimize lost time and drilling duration by maximizing borehole cleaning, particularly in extended reach and deviated wells.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and are not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A drilling system, comprising:

a drill string extendable into a borehole from a drilling platform and operable to convey a drilling fluid to a drill bit arranged at a distal end of the drill string, the drill string having a plurality of access openings;

an annulus defined between an outer surface of the drill string and an inner wall of the borehole and in which spent drilling fluid ejected from the drill bit flows back to the drilling platform; and a plurality of nozzle assemblies installed on the drill string, each nozzle assembly being arranged at a respective one of the plurality of access openings and providing a fluid flow path between an interior of the drill string and the annulus via the respective one of the plurality of access openings, wherein each nozzle assembly includes a sealing member movable radially outward from the access opening associated therewith and towards the annulus, and wherein each sealing member is transitionable between a closed state, in which the sealing member blocks and generates a sealed interface at the access opening associated therewith and thereby prevents drilling fluid within the interior from passing through the fluid flow path associated therewith, and an open state, in which the sealing member extends radially outward and separates from the access opening associated therewith to thereby allow the drilling fluid to traverse the fluid flow path and discharge into the annulus to combine with the spent drilling fluid.

2. The drilling system of claim 1, wherein each nozzle assembly further comprises a nozzle secured within a dedicated pocket defined in an outer surface of the drill string.

3. The drilling system of claim 2, wherein the nozzle is arranged within the dedicated pocket at an angle offset from perpendicular to a centerline of the drill string.

4. The drilling system of claim 2, wherein the nozzle is arranged within the dedicated pocket at an angle such that the drilling fluid is discharged from the nozzle into the annulus in an uphole direction.

5. The drilling system of claim 2, wherein each nozzle assembly further comprises a spring operatively coupled to the sealing member and actuatable between an unextended state, which places the sealing member in the closed state, and an extended state, which places the sealing member in the open state.

6. The drilling system of claim 5, wherein actuation of the spring between the unextended and extended states is based on a hydraulic pressure of the drilling fluid within the interior.

7. The drilling system of claim 6, wherein the spring is actuated to the extended state when the hydraulic pressure exceeds a spring force of the spring.

8. The drilling system of claim 5, wherein each sealing member is in the closed state when the spring is in the unextended state, and each sealing member is in the open state when the spring is in the extended state.

9. The drilling system of claim 1, wherein at least two of the plurality of nozzle assemblies are axially aligned on the drill string.

10. The drilling system of claim 1, wherein at least two of the plurality of nozzle assemblies are axially offset from each other on the drill string.

11. A method of drilling a borehole, comprising:

extending a drill string into the borehole from a drilling platform, the drill string having a drill bit arranged at a distal end thereof and defining a plurality of access openings, wherein a nozzle assembly is arranged in each access opening, each nozzle assembly operable to provide a fluid flow path through the respective access opening and between an interior of the drill string and an annulus defined between the drill string and an inner wall of the borehole, wherein each nozzle assembly includes a sealing member that is movable radially outward from the access opening associated therewith towards the annulus;

conveying a drilling fluid into the drill string and to the drill bit;

discharging a spent drilling fluid from the drill bit and into the annulus;

transitioning at least one of the sealing members from a closed state, in which the sealing member blocks and generates a sealed interface at the access opening associated therewith and prevents drilling fluid within the interior from passing through the fluid flow path associated therewith, to an open state, in which the sealing member extends radially outward from the access opening associated therewith so that the sealing member is separated from the access opening to thereby allow drilling fluid to traverse the fluid flow path and discharge into the annulus; and combining the drilling fluid discharged into the annulus with the spent drilling fluid and thereby aiding the spent drilling fluid in carrying drill cuttings uphole within the annulus.

12. The method of claim 11, wherein each nozzle assembly comprises a nozzle secured within a dedicated pocket defined in an outer surface of the drill string.

13. The method of claim 12, wherein each nozzle assembly further includes a spring operatively coupled to the sealing member, the method further comprising:

actuating the spring between an unextended state, where the sealing member generates the sealed interface at the access opening, and an extended state, where the sealing member separates from the access opening and thereby allows the drilling fluid to enter the dedicated pocket to be discharged into the annulus via the nozzle.

14. The method of claim 13, wherein actuating the spring from the unextended state to the extended state comprises increasing a hydraulic pressure of the drilling fluid within the interior and thereby exceeding a spring force of the spring.

15. The method of claim 11, further comprising discharging the drilling fluid from the at least one of the plurality of nozzle assemblies at an angle such that the drilling fluid is discharged from the nozzle into the annulus in an uphole direction.

* * * * *